US005820620A

United States Patent [19]

Allison-Rogers

[11] Patent Number: 5,820,620

[45] Date of Patent: Oct. 13, 1998

[54] WATERPROOF PANTS FOR ABSORBENT PADS

[76] Inventor: Susan Margaret Allison-Rogers, 24 Waimea Ave., Sandy Bay, Tasmania 7005, Australia

[21] Appl. No.: 211,222

[22] PCT Filed: Sep. 25, 1992

[86] PCT No.: PCT/AU92/00515

§ 371 Date: Mar. 25, 1994

§ 102(e) Date: Mar. 25, 1994

[87] PCT Pub. No.: WO93/05744

PCT Pub. Date: Apr. 1, 1993

[30] Foreign Application Priority Data

Sep. 26, 1991 [AU] Australia ..... PK8600

[51] Int. Cl.[6] ..... A61F 13/15

[52] U.S. Cl. ..... 604/385.2; 604/391; 604/317; 604/348; 604/402; 2/401

[58] Field of Search ..... 604/385.1–389, 604/391–402, 373; 402/400, 401, 402, 406

[56] References Cited

U.S. PATENT DOCUMENTS

| | | | |
|---|---|---|---|
| 3,417,751 | 12/1968 | Murdoch . | |
| 3,530,859 | 9/1970 | Heimowitz | 604/386 |
| 4,699,622 | 10/1987 | Toussant et al. | 604/389 |
| 4,846,823 | 7/1989 | Enloe . | |
| 4,978,345 | 12/1990 | Holliday et al. | 604/384 |

FOREIGN PATENT DOCUMENTS

| | | | |
|---|---|---|---|
| 0 073 183 | 3/1983 | European Pat. Off. . | |
| 188667 | 2/1957 | Germany . | |
| 1070779 | 12/1959 | Germany | 604/397 |
| 2825028 | 10/1979 | Germany | 604/389 |
| 1246402 | 10/1984 | Japan . | |
| 790062 | 2/1958 | United Kingdom | 604/397 |
| WO 92/07536 | 5/1992 | WIPO . | |

*Primary Examiner*—John G. Weiss
*Assistant Examiner*—K. M. Reichle
*Attorney, Agent, or Firm*—Larson & Taylor

[57] ABSTRACT

A garment for use with an absorbent product such as sanitary napkins and cloth or disposable nappies or pads for babies and incontinent children and adults is disclosed. The garment is adapted to fit around the crotch of a user to hold the absorbent product against the user. The garment includes a layer (3) of liquid-resistant or liquid-impervious material to contact the outer surface of the absorbent product to minimize leakage of body fluids. The layer (3) is characterized by darts (15) extending along the sides of the garment that define leg openings to minimize lateral movement of the absorbent product with respect to the garment and to form wet guards to minimize leakage of body fluids through the leg openings. In a preferred embodiment the garment also includes hook and loop fasteners (13) to releasably hold the garment around the waist of the user which are arranged so that the fastening is to the rear of the user.

7 Claims, 1 Drawing Sheet

WATERPROOF PANTS FOR ABSORBENT PADS

FIELD OF THE INVENTION

The present invention relates to a garment for use with sanitary napkins and cloth or disposable nappies or pads for babies and incontinent children and adults.

BACKGROUND OF THE INVENTION

An important requirement of sanitary napkins and nappies or pads for babies and incontinent children and adults is a capacity to prevent leakage. In particular, the leakage of body fluids from nappies or pads can have a devastating social impact on incontinent children and adults.

The term "absorbent products" is herein understood to mean sanitary napkins and cloth or disposable nappies or pads for babies and incontinent children and adults.

SUMMARY OF THE INVENTION

An object of the present invention is to provide a garment for use with absorbent products to maintain the absorbent products in position and to retain any body fluids that may leak from the absorbent products.

According to the present invention there is provided a garment for use with an absorbent product, the garment being adapted to fit around the crotch of a user to hold the absorbent product against the user, the garment comprising a layer of liquid-resistant or liquid-impervious material to contact the outer surface of the absorbent product to minimise leakage of body fluids from the absorbent product, and the layer of liquid-resistant or liquid-impervious material having darts extending at least partially along each side of the garment which define leg openings of the garment to minimise lateral movement of the absorbent product with respect to the garment and to form wet guards to minimise leakage of body fluids through the leg openings.

It is preferred that the garment be generally rectangular in configuration and comprises ends and sides which define waist and leg-openings, respectively, of the garment when the garment is positioned on the user.

It is preferred that the garment comprises fastening means to releasably hold the garment around the waist of the user.

It is particularly preferred that the fastening means comprises hook and loop fasteners.

It is particularly preferred that the hoop and loop fasteners be arranged so that the fastening is to the rear of the user.

It is preferred that the ends and sides comprise borders of stretchable fabric to hold the garment snugly to the waist and legs of the user.

It is preferred that the darts be elasticised.

It is particularly preferred that each dart be formed by fixing a stretched length of elastic material in a fold of the liquid-resistant or liquid-impervious material along one of the sides of the garment and stitching together the sides of the fold to enclose the stretched elastic material and thereby form the dart.

It is preferred that the garment further comprises a dart along the end which forms the front of the garment when positioned on the user.

BRIEF DESCRIPTION OF THE DRAWINGS

The present invention is described further with reference to the accompanying drawings in which.

DETAILED DESCRIPTION OF THE PREFERRED EMBODIMENTS

The garment shown in the figures is formed from an inner layer 3 and an outer layer 5 of liquid-resistant fabric, such as coated nylon (which can "breathe"), and an intermediate layer 6 of a padding material, such as polyester wadding, enclosed within the inner and outer layers 3, 5.

Figure 1:
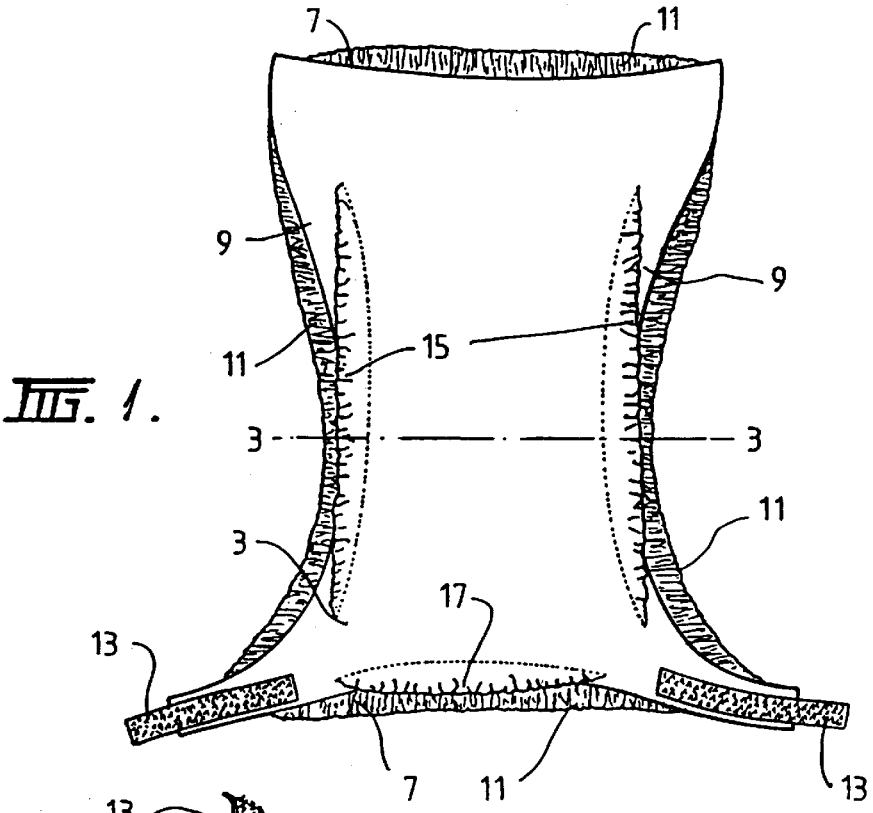
FIG. 1 is a plan view of a preferred embodiment of a garment formed in accordance with the present invention as it would appear stretched flat prior to positioning on a user.
Figure 2:
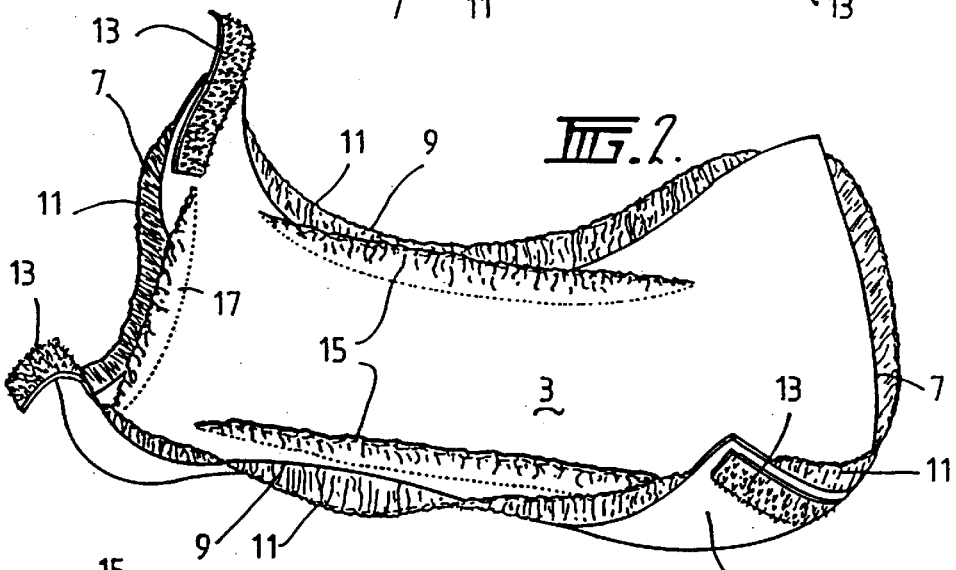
FIG. 2 is a perspective view of the garment shown in FIG. 1.
Figure 3:
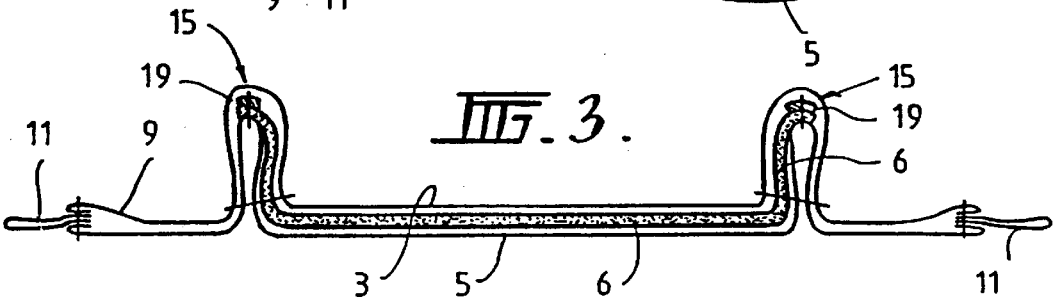
FIG. 3 is a section along the line 3—3 in FIG. 1.

The garment is generally rectangular in configuration when stretched flat as shown in FIG. 1 and comprises ends 7 and sides 9 which form the waist and leg openings, respectively, of the garment when the garment is positioned on a user. The ends 7 and sides 9 comprise borders 11 of stretchable fabric to hold the garment snugly to the waist and the legs of the user.

The garment further comprises elasticised darts 15 extending at least partially along the sides 9 of the garment. In a preferred embodiment of the invention the garment is formed with elasticised darts by:

(a) positioning the intermediate layer 6 on the outer layer 5;

(b) positioning lengths of stretched elastic material 19 on each side of the intermediate layer 6;

(c) stitching the lengths of stretched elastic material 19 to the outer layer 5 and the intermediate layer 6;

(d) positioning the inner layer 3 on the intermediate layer 6; and (e) stitching together sections of the inner layer 3 on opposite sides of each length of stretched elastic material 19 to enclose the lengths of stretched elastic material 19 in the resultant darts.

It is noted that in the above-described preferred embodiment of the invention the darts 15 include polyester wadding so that the darts 15 are relatively "soft" to thereby minimise chafing of the user.

It is also noted that the stretched elastic material 19 shapes the garment into a pant-like configuration.

The garment further comprises an elasticised dart 17 along the end 7 of the garment which forms the front of the garment when positioned on a user. The elasticised dart is formed in the same way as the darts 15.

The garment further comprises fastening means in the form of hook and loop fasteners 13 on the corners of the garment. In the preferred embodiment shown in the figures the hook and loop fasteners 13 are arranged so that the fastening is to the rear of the user.

The garment has a number of advantages, some of which are summarised below.

1. The side darts 15 and the front dart 17 define a boundary for locating an absorbent product and preventing lateral movement of the absorbent product with respect to the garment. This is important for a number of reasons, including the fact that correct positioning of the absorbent product is a function solely of the garment and not the absorbent product and the garment.

2. The side darts 15 and the front dart 17 define seals to prevent leakage of body fluids through the leg openings and front of the garment.

3. The garment can be easily formed without the use of complicated equipment.

4. The use of an inner layer 3 and an outer layer 5 of a liquid-resistant fabric and an intermediate layer 6 of a padding material forms a garment which is able to substantially prevent leakage of body fluids from an absorbent product and can "breathe" thereby minimising discomfort to the user if the garment is on the user for prolonged periods.

Many modifications may be made to the preferred embodiment described with reference to the drawings without departing from the spirit and scope of the present invention.

For example, whilst the preferred embodiment comprises an essentially rectangular garment which in use is wrapped around the crotch of a user and fastened by fastening means, it can readily be appreciated that the present invention is not limited to such a construction an extends to garments which have a continuous stretchable waist with closed leg openings.

Furthermore, whilst the preferred embodiment is formed from three layers of fabric/material which can "breathe", it can readily be appreciated that any suitable number of layers (including a single layer) of any suitable fabric/material could be used to form the garment bearing in mind that the major requirement of the garment is to minimise leakage of body fluid from an absorbent product. In this regard, it is noted that it is within the scope of the present invention to form the garment from a liquid-impervious material.

Furthermore, whilst the preferred embodiment is formed by folding the inner layer of the garment around a stretched length of elastic material fixed to the garment, it can readily be appreciated that the present invention is not limited to such a method and may be formed by any suitable method.

Furthermore, whilst the preferred embodiment comprises hook and loop fasteners, it can readily be appreciated that the present invention is not limited to such a construction and extends to any suitable fastening means.

Finally, whilst the preferred embodiment comprises hook and loop fasteners which fasten to the rear of the user, it can readily be appreciated that the present invention is not limited to such a construction and extends to front attachment of hook and loop fasteners.

I claim:

1. A garment for use with a separate absorbent product, the garment being adapted to fit around a crotch of a user to hold the absorbent product against the user, the garment comprising, a front end, a back end, and sides extending between the front and back end when the garment is positioned on the user, a layer of liquid-resistant or liquid-impervious material to minimize leakage of body fluids from the absorbent product, and an elasticized dart extending at least partially along each of the sides of the garment which define leg openings of the garment to minimize lateral movement of the absorbent product with respect to the garment and to form upstanding wet guards to minimize leakage of body fluids through the leg openings, each dart being formed by forming a fold of the layer of liquid-resistant or liquid impervious material along each of the sides of the garment and stitching together the sides of the fold.

2. The garment defined in claim 1, further comprising an elasticized, upstanding dart along the end which forms the front of the garment.

3. The garment defined in claim 1 comprising a generally rectangular configuration with the ends and the sides defining a waist and the leg-openings, respectively, of the garment when the garment is positioned on the user.

4. The garment defined in claim 3, wherein the ends and the sides comprise borders of stretchable fabric to hold the garment snugly to a waist and legs of the user.

5. The garments defined in claim 1, further comprising a fastening means to releasably hold the garment around a waist of the user.

6. The garment defined in claim 5, wherein the fastening means comprises hook and loop fasteners.

7. The garment defined in claim 6, wherein the hook and loop fasteners are arranged to releasably hold the garment around the waist to a rear of the user.

* * * * *